US006662968B2

(12) United States Patent
Clements

(10) Patent No.: US 6,662,968 B2
(45) Date of Patent: Dec. 16, 2003

(54) PRODUCT DISPENSER FOR VARIABLE STACKED ARTICLES

(76) Inventor: Matthew J. Clements, 320 Fort Duquesne Blvd., Pittsburgh, PA (US) 15222

( * ) Notice: Subject to any disclaimer, the term of this patent is extended or adjusted under 35 U.S.C. 154(b) by 63 days.

(21) Appl. No.: 10/131,738

(22) Filed: Apr. 24, 2002

(65) Prior Publication Data

US 2003/0201278 A1 Oct. 30, 2003

(51) Int. Cl.[7] ..... B65H 31/20
(52) U.S. Cl. ..... 221/242; 221/277
(58) Field of Search ..... 221/187, 181, 221/231, 154, 222, 241, 242, 197

(56) References Cited

U.S. PATENT DOCUMENTS 3,265,243 A * 8/1966 Velter ..... 221/63
3,757,998 A * 9/1973 Millies et al. ..... 221/242
6,247,611 B1 6/2001 Clements et al.

* cited by examiner

*Primary Examiner*—Kenneth W. Noland
(74) *Attorney, Agent, or Firm*—McKay & Associates, P.C.

(57) ABSTRACT

A product dispenser of the type adapted to release articles from vertical stacks is disclosed, which is configured to dispense a variety of articles whether in bulk or singularly. The present vending apparatus provides a main housing that is configured to receive interchangeable release mechanisms, with each mechanism dependent upon whether the dispensed article(s) is generally flat or of the small round type distributed by bulk similar to candies. The bottom surface of the product compartment defined on the top of main housing is configured to allow variability in the type of products released from the vertically mounted product cartridge.

21 Claims, 5 Drawing Sheets

PRODUCT DISPENSER FOR VARIABLE STACKED ARTICLES

BACKGROUND

1. Field of the Invention

The present invention relates generally to vending machines that are adapted to dispense vertically stacked articles from top-mounted product cartridges. In particular, a product dispenser is disclosed having a main housing configured to receive and release a variety of stacked articles using interchangeable release mechanisms.

2. Description of the Related Art

U.S. Pat. No. 6,247,611 B1 to Clements et al. shows a vending apparatus for containing and releasing generally box-shaped or flat articles. The articles are vertically stacked, and the release mechanisms push the bottommost article out of the cartridge. The above invention is configured to release particular types of articles that are shaped similar to pill packets or box-like shaped packages of candy, as they are pushed rearward from the cartridges.

SUMMARY

It is an objective of the present invention to provide a product dispenser of the type adapted to release articles from vertical stacks, which is configured to dispense variable articles, and not solely generally flat products. The above feature is achieved by providing a main housing that is configured to receive interchangeable release mechanisms, with each mechanism dependent upon whether the dispensed article(s) is generally flat or of the small round type distributed by bulk similar to candies.

Accordingly, what is provided is a product dispenser, with a main housing having a top surface, a housing front, and an interior. A product compartment is defined on the top surface having a bottom surface configured as a pair of flanges either hingedly or fixedly attached to opposing sides of the product compartment, wherein, when attached by a hinge, the flanges are adapted to articulate and define an opening of variable size when the flanges are in an up-position or a down-position.

Interchangeable release mechanisms are removably mounted on the housing front and positioned underlying the bottom surface. The release mechanisms either comprise a rotating arm configured to be turned by a turning knob, wherein the rotating arm may pass between the flanges when the flanges are in the up-position, or a cylindrical cam is adapted to be rotated by a turning knob. The cylindrical cam has a cam surface and a cup-like trough defined thereon, wherein the trough can move generally small products away from the product compartment when the flanges are in the down-position.

The product cartridges can either be pre-packaged or refilled with the goods and are vertically mounted to the top surface of the main housing within the product compartment and can also be interchanged accordingly to meet the needs of the consumer.

DETAILED DESCRIPTION OF THE PREFERRED EMBODIMENT

Figure 1:
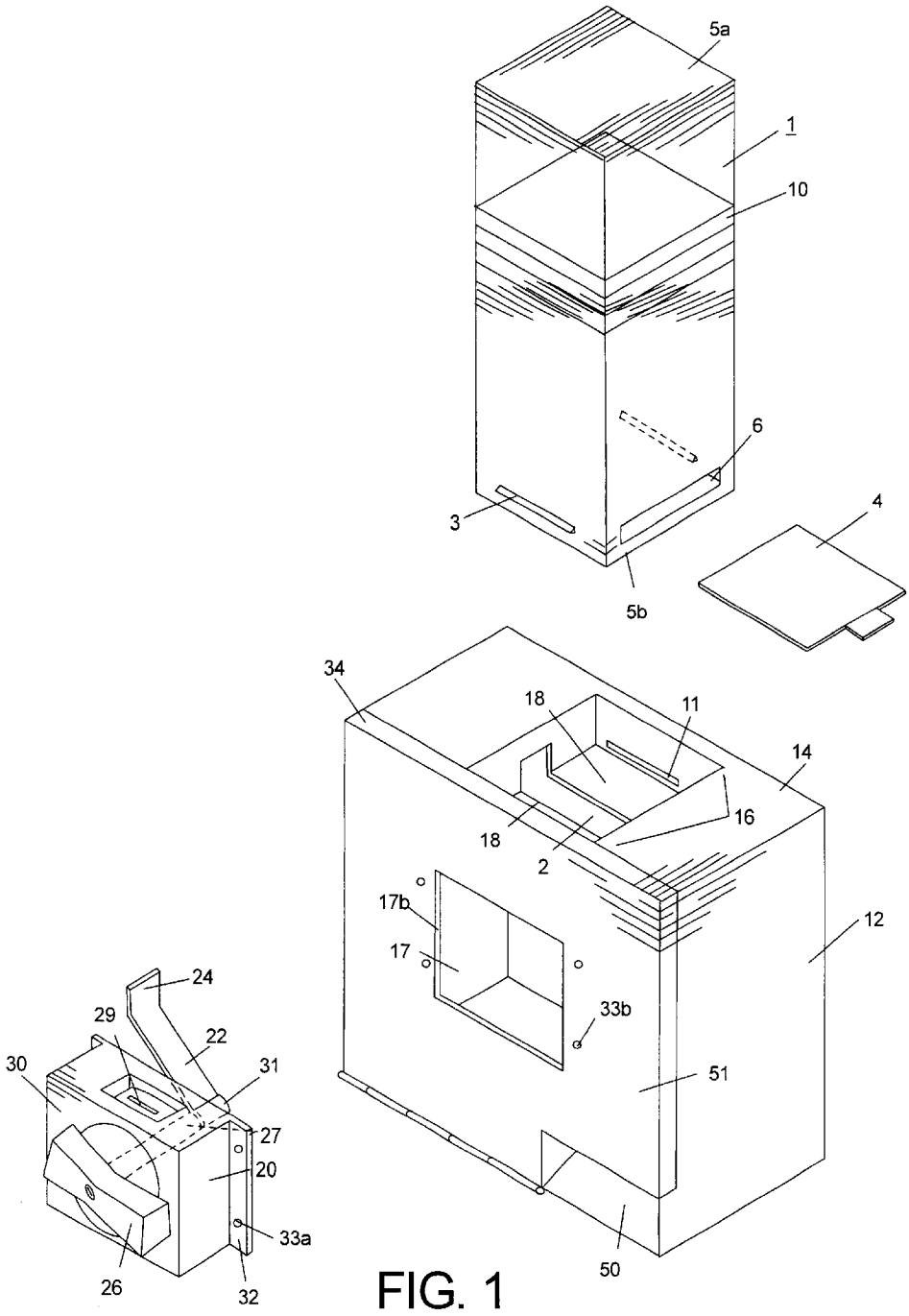
FIG. 1 shows an exploded view of the main components of the present invention.
Figure 2:
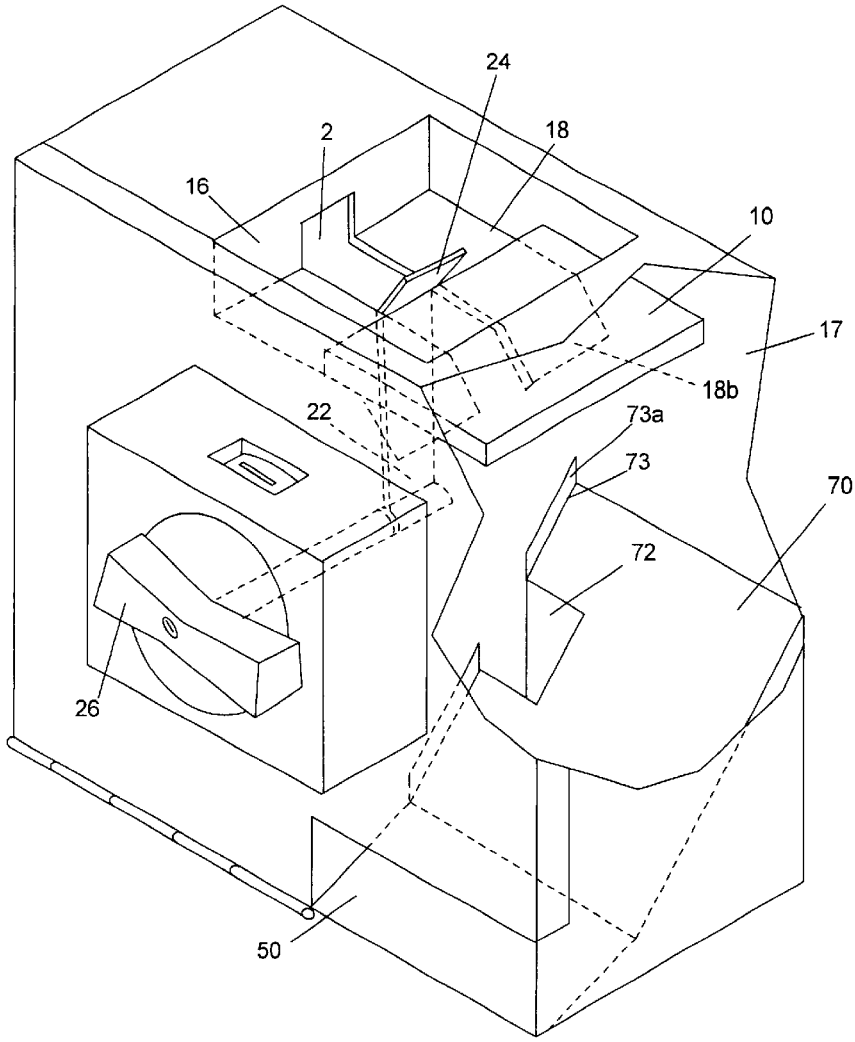
FIG. 2 shows a perspective broken view of the main housing revealing the interior thereof.
Figure 3:
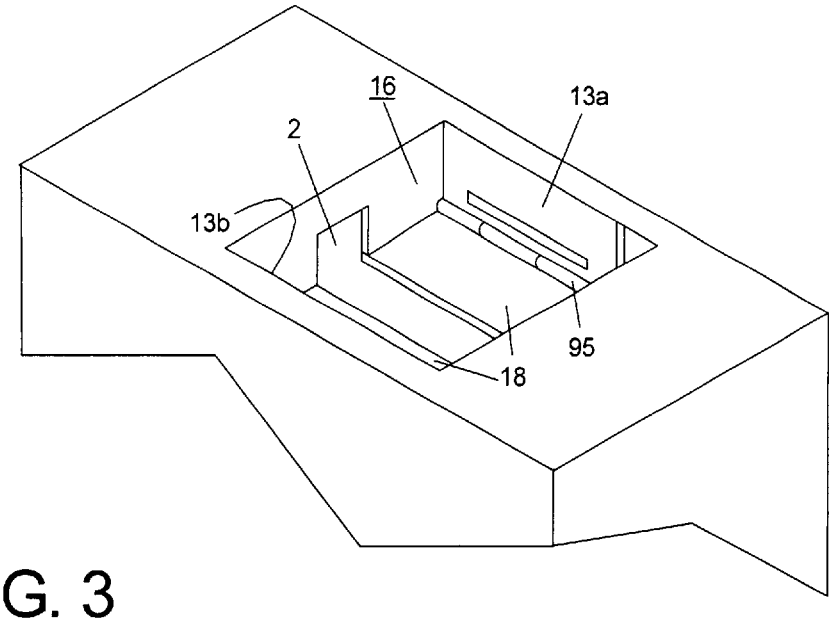
FIG. 3 shows an enlarged view of the product compartment with flange in up-position.
Figure 4:
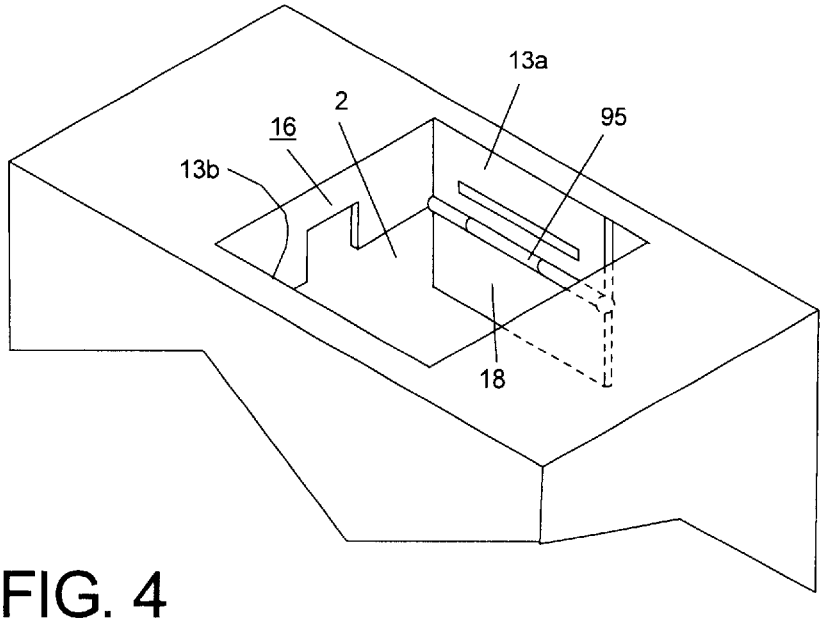
FIG. 4 shows an enlarged view of the product compartment with flange in down-position.
Figure 5:
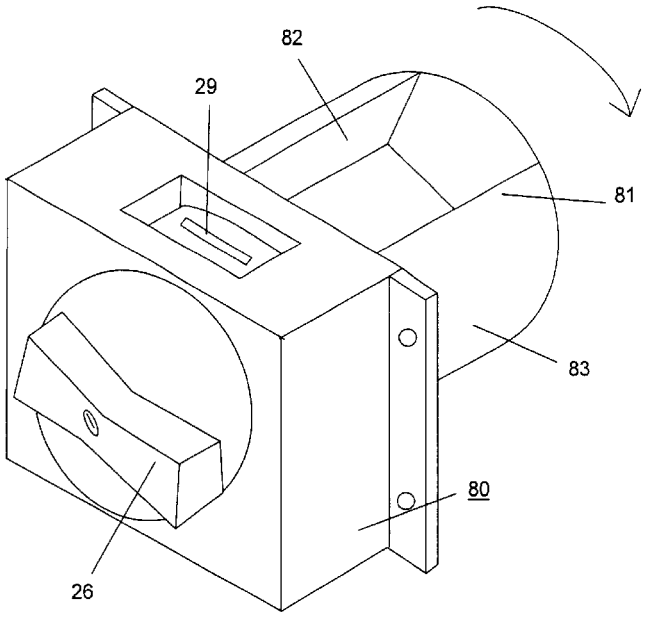
FIG. 5 shows a perspective view of the alternative release mechanism used for bulk-vending.
Figure 6:
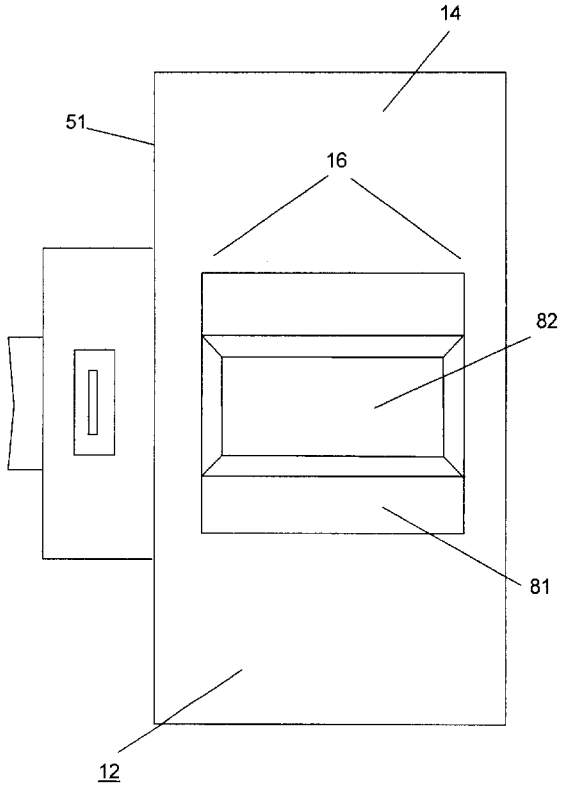
FIG. 6 shows a top view of the alternative release mechanism.

FIGS. 1–2 show the main components of the present invention. A generally rectangular product cartridge 1 is adapted to be vertically mounted above a main housing 12. A pair of cartridge latches 3 are attached on the exterior of opposing sides of the product cartridge 1 located proximate to the cartridge bottom 5*b*. Each latch 3 is configured to be received by a complementary pair of latch openings 11 positioned in opposition on the sides 13*a*, 13*b* within the product compartment 16. Product compartment 16 is defined on the top surface 14 of the main housing 12, thus allowing the attachment of the product cartridge 1 to the main housing 12. The product cartridge 1 may be removed by squeezing an area above the cartridge bottom and by snapping the cartridge latches 3 from the latch openings 11. As is generally known in the art, the product cartridge 1 may further be secured to the main housing by other attachment means including but not limited to a screw mechanism. A flanged bottom similar to that shown by U.S. Pat. No. 6,247,611 may also be used if housing front 51 is hingedly attached as a security door 34. The entire disclosure of U.S. Pat. No. 6,247,611 is herein incorporated by reference.

The product compartment 16 having the latch openings 11 is generally defined by an indentation in the top surface 14 complementary to the shape of the cartridge bottom 5*b*. The bottom surface of the product compartment 16 is configured, in this embodiment, as a pair of opposing flanges 18 that define a channel-like opening 2 through which a rotating arm 22 of release mechanism 20 may pass.

In operation of this embodiment then, rotating arm 22 rotates through channel-like opening 2. Arm tab 24 of arm 22 contacts at least one of the products 10 when turning knob 26 rotates axis rod 27 after product cartridge 1 is mounted within product cartridge 16. Arm 22 is securely mounted on distal end 31 of axis rod 27, and turning knob 26 is attached to axis rod 27 and mounted on the front face 30 of release mechanism 20.

Release mechanism 20 is removably mounted on housing front 51 of main housing 12 using any type of rivets or screws inserted through holes 33*a*, 33*b* of integral mechanism flange 32. In the preferred embodiment, security door 34 is unlocked and/or opened and release mechanism is interfitted through housing opening 17*b* of housing front 51 with mechanism flange 32 attached within housing interior 17 on the backside of security door 34. In an alternative embodiment, release mechanism 20 may also be removably attached to the exterior of main housing 12 on main housing front 51 if security door 34 is not present. Release mechanism 20 may include any type of coin slot 29 and activation mechanism as is generally known in the art.

Products 10 may be prepared for dispensing after a tab 4 or other similar cap is removed from a slot 6 near cartridge bottom 5*b*. Thus, one of products 10 rests on bottom surface of product compartment 16 when product cartridge 1 is mounted on top surface 4 of main housing 12. At least one of products 10 is now ready to be released.

Within the housing interior 17 of main housing 12, a declining ramp 70 is positioned indirectly underlying flanges 18, adjacent to product compartment 16 situated at the bottom of housing interior 17. A product exitway 50 defines an opening through which product 10 will approach.

In operation, upon manual rotation of turning knob 26, at least one of products 10 is pushed horizontally off of flanges 18 as arm 22 travels through opening 2 and falls to ramp 70. Product 10 then proceeds to slide down by gravity to product exitway 50 and can be retrieved. In one embodiment, a pair of flange tips 18*b* may be integrally attached to and angle down from flanges 18 to facilitate the downward fall of product 10 to ramp 70.

Furthermore, a vertical channel disposed within ramp 70 defines an arm pathway 72. If ramp 70 is situated proximate to the arm tab 24 when rotation of arm 22 occurs, arm pathway 72 will assure travel through ramp 70. Otherwise, the ramp is generally integral throughout and shaped in any particular way that can assure passage of product 10 to product exitway 50.

In the preferred embodiment and with further reference to FIGS. 1–4, flanges 18 of product compartment 16 are attached to opposing compartment sides 13*a*, 13*b* by an underlying hinge 95 or similar device. Hinge 95 provides a enough resistance to allow flanges 18 to be articulated within a ninety degree range, whereby when in its up position, flange 18 is situated perpendicular and can seat generally flat products 10. When in its down position, each flange 18 is positioned at an approximate 180-degree angle relative to the opposing compartment sides 13*a*, 13*b*. Opening 2 is then defined to be of equal area as product compartment 16 and allows for the dispensing of alternative products that are not generally rectangular and do not require a platform means.

Furthermore, these alternative products are dispensed using a different embodiment of the release mechanism 20 (FIG. 1) as is further described. Thus, main housing 12 is configured to allow the release of a variety of stacked products when the release mechanisms 20 are switched.

Referencing now FIGS. 1–5, FIGS. 4 and 5 show the alternative release mechanism, termed herein bulk release mechanism 80, for releasing products which are smaller, and generally distributed by bulk similar to small candies (not shown).

A generally cylindrical cam 83 is connected to and is adapted to be rotated by turning knob 26. A trough 82 is defined by a cup-like indentation on the cam surface 81. Bulk release mechanism 80 is attached to housing front 51 in a similar manner as release mechanism 20 using mechanism flanges 32 (exteriorly or interiorly). Thus trough 82 is positioned underlying product compartment 16 of top surface 14 of main housing 12 and below flanges 18 when flanges 18 are in down position. In this manner, flanges 18 may also serve to retain the position of and guide any type of small products into trough 82 when falling from product cartridge 1. As described previously, the small products will proceed to fall out of trough 82 upon rotation of cam 83 and be emptied onto ramp 70. Any type of modification may be made to ramp 70 to assure passage of any products to product exitway 50, such as a raised lip 73*a* on the interior edge 73 of ramp 70. As rotation of cam 83 continues, remaining small products falling from product cartridge 1 will contact cam surface 81 until trough 82 completes rotation for next product containment and release. As is generally known in the art, rotation activation may proceed upon deposition of a coin through coin slot 29.

It should be understood that the present invention is not limited to the type of product cartridge 1 (FIG. 1) used in conjunction with main housing 12. A generally rectangular product cartridge 1 is used for illustration purposes. Accordingly, the product cartridge 1 may be transparent or be made of any type of material such as cardboard or plastic.

Figure 7:
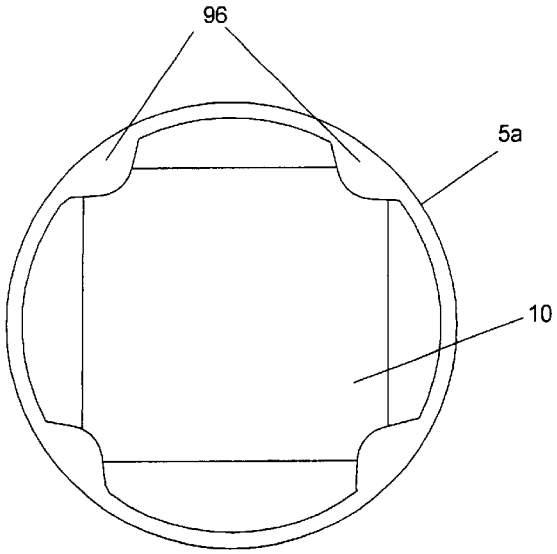
FIG. 7 shows a top view of an alternative embodiment of the product cartridge.
Figure 8:
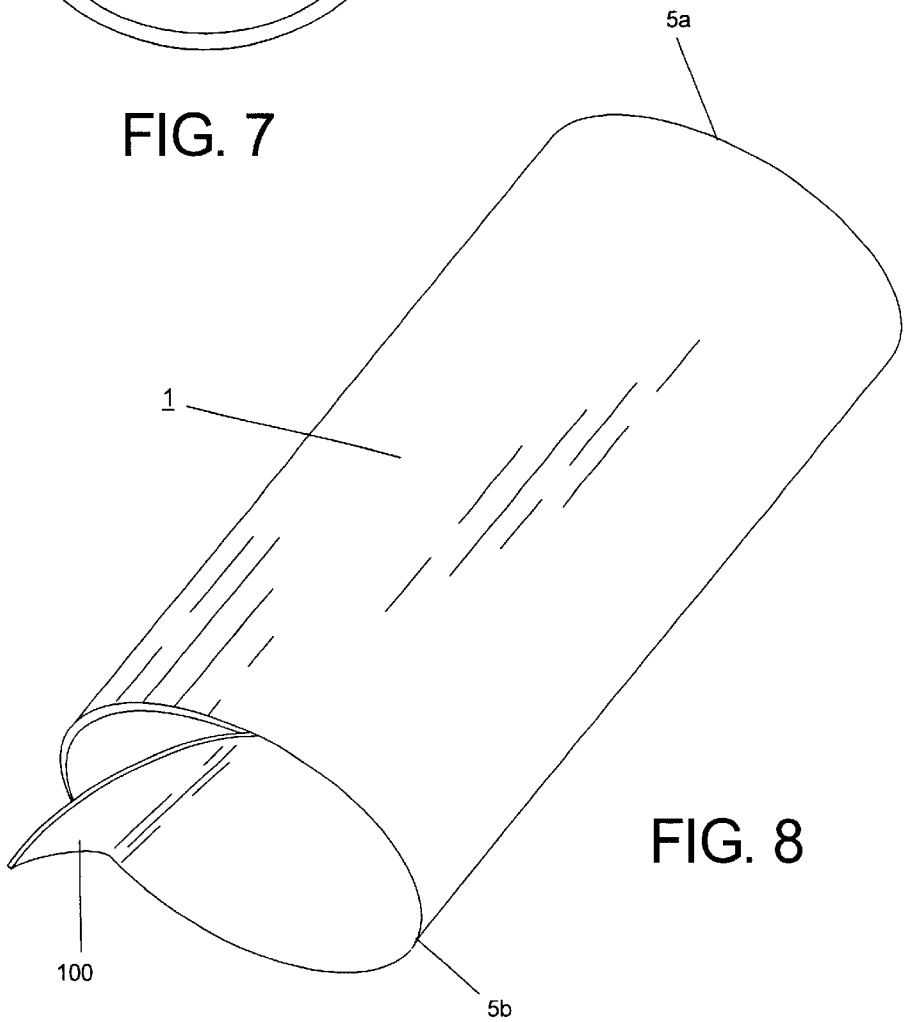
FIG. 8 shows a perspective view of the alternative product cartridge.

FIGS. 7 and 8 show an alternative embodiment of the product cartridge 1 (FIG. 1) of the present invention. A generally cylindrical product cartridge 1 may be used to store the dispensed products 10, and if the products 10 are generally flat and rectangular, the cartridge top 5*a* may be embossed with projections to secure the corners of the uppermost product 10. As would be known, product compartment 16 (FIG. 1) would be modified accordingly to allow product cartridge 1 attachment. Also, in this embodiment, a peel-away cap 100 is shown and is removably attached to the cartridge bottom 5*b*.

I claim:

1. A product dispenser, comprising:

a main housing having a top surface, a housing front, and an interior;

a product compartment defined on said top surface having a bottom surface configured as a pair of flanges hingedly attached to opposing sides of said product compartment, wherein said flanges are adapted to articulate and define an opening of variable size when said flanges are in an up-position or a down-position; and, a release mechanism removably mounted on said housing front and positioned underlying said bottom surface.

2. The product dispenser of claim 1, wherein said housing front is hingedly attached as a security door to said main housing.

3. The product dispenser of claim 1, wherein said product compartment further comprises a pair of latch openings positioned in opposition on said opposing sides.

4. The product dispenser of claim 1, further comprising a product cartridge adapted to be vertically mounted above said main housing within said product compartment.

5. The product dispenser of claim 1, further comprising a declining ramp positioned within said interior indirectly underlying said flanges of said product compartment.

6. The product dispenser of claim 1, wherein said release mechanism further comprises a rotating arm configured to be turned by a turning knob, wherein said rotating arm may pass between said flanges when said flanges are in said up-position.

7. The product dispenser of claim 1, wherein said release mechanism further comprises a cylindrical cam adapted to be rotated by a turning knob, said cylindrical cam having a cam surface and a cup-like trough defined thereon, wherein said trough can move generally small products away from said product compartment when said flanges are in said down-position.

8. A product dispenser, comprising:

a main housing having a top surface, a housing front, and an interior;

a product compartment defined on said top surface having a bottom surface configured as a pair of flanges attached to opposing sides of said product compartment, wherein said flanges define a channel-like opening; and, a release mechanism removably mounted on said housing front and positioned underlying said bottom surface, said release mechanism further comprising a rotating arm configured to be turned by a turning knob, wherein said rotating arm may pass through said channel-like opening to move generally rectangular products out of said product compartment.

9. The product dispenser of claim 8, wherein said housing front is hingedly attached as a security door to said main housing.

10. The product dispenser of claim 8, wherein said product compartment further comprises a pair of latch openings situated in opposition on said opposing sides.

11. The product dispenser of claim 8, further comprising a product cartridge adapted to be vertically mounted above said main housing within said product compartment.

12. The product dispenser of claim 8, wherein flange tips are integrally attached to and angle down from said flanges.

13. The product dispenser of claim 8, further comprising a declining ramp positioned within said interior indirectly underlying said flanges of said product compartment.

14. A product dispenser, comprising:

a main housing having a top surface, a housing front, and an interior;

a product compartment defined on said top surface and revealing said interior;

a product cartridge removably attached to said product compartment having a cartridge bottom shaped complementary to said product compartment, whereby said product cartridge is vertically mounted on said top surface of said main housing;

a bulk release mechanism removably mounted on said housing front and positioned underlying said product compartment, said bulk release mechanism further comprising a cylindrical cam adapted to be rotated by a turning knob, said cylindrical cam having a cam surface and a cup-like trough defined thereon, wherein said trough can move generally small products away from said product compartment after said small products are released from said product cartridge.

15. The product dispenser of claim 14, wherein said housing front is hingedly attached as a security door to said main housing.

16. The product dispenser of claim 14, wherein said product cartridge is generally rectangular and a pair of cartridge latches are oppositely attached on an exterior thereof.

17. The product dispenser of claim 14, further comprising a declining ramp positioned within said interior indirectly underlying said flanges of said product compartment.

18. A product dispenser, comprising:

a main housing having a top surface, a housing front, and an interior;

a product compartment defined on said top surface having a bottom surface configured as a pair of flanges attached to opposing sides of said product compartment, wherein said flanges define a channel-like opening;

a declining ramp positioned indirectly underlying said pair of flanges situated at the bottom of said interior of said housing, whereon a product may fall and proceed by gravity to a product exitway; and, a release mechanism removably mounted on said housing front and positioned underlying said bottom surface.

19. The product dispenser of claim 18, wherein said housing front is hingedly attached as a security door to said main housing.

20. The product dispenser of claim 18, wherein said product compartment further comprises a pair of latch openings positioned in opposition on opposing sides thereof.

21. The product dispenser of claim 18, further comprising a product cartridge adapted to be vertically mounted above said main housing within said product compartment.

* * * * *